US008833465B2

(12) United States Patent
Kotrla et al.

(10) Patent No.: US 8,833,465 B2
(45) Date of Patent: Sep. 16, 2014

(54) SUBSEA DIFFERENTIAL-AREA ACCUMULATOR

(75) Inventors: Johnnie E. Kotrla, Katy, TX (US); Mac Kennedy, Houston, TX (US); Nathan Cooper, Houston, TX (US)

(73) Assignee: Cameron International Corporation, Houston, TX (US)

( * ) Notice: Subject to any disclaimer, the term of this patent is extended or adjusted under 35 U.S.C. 154(b) by 355 days.

(21) Appl. No.: 13/003,150

(22) PCT Filed: Aug. 4, 2009

(86) PCT No.: PCT/US2009/052709

§ 371 (c)(1),
(2), (4) Date: Jan. 7, 2011

(87) PCT Pub. No.: WO2010/017200

PCT Pub. Date: Feb. 11, 2010

(65) Prior Publication Data

US 2011/0147002 A1 Jun. 23, 2011

Related U.S. Application Data

(60) Provisional application No. 61/086,029, filed on Aug. 4, 2008.

(51) Int. Cl.

| | |
|---|---|
| ***E21B 7/12*** | (2006.01) |
| ***E21B 33/064*** | (2006.01) |
| ***F15B 21/00*** | (2006.01) |
| ***E21B 33/035*** | (2006.01) |
| ***F15B 1/24*** | (2006.01) |
| *F15B 3/00* | (2006.01) |

(52) U.S. Cl.

CPC ..... *E21B 33/064* (2013.01); *F15B 21/006* (2013.01); *F15B 2201/31* (2013.01); *F15B 3/00* (2013.01); *F15B 2201/205* (2013.01); *E21B 33/0355* (2013.01); *F15B 1/24* (2013.01)

USPC ..... 166/363; 166/358; 166/364

(58) Field of Classification Search

USPC ..... 166/363–364; 60/413; 138/31

See application file for complete search history.

(56) References Cited

U.S. PATENT DOCUMENTS 2,790,462 A * 4/1957 Ashton ..... 138/31
3,436,914 A * 4/1969 Rosfelder ..... 60/398

(Continued)

FOREIGN PATENT DOCUMENTS

WO 0188323 A1 11/2001

OTHER PUBLICATIONS

PCT/US2009/052709 International Search Report and Written Opinion, Mar. 16, 2010 (10 p.).

*Primary Examiner* — Matthew Buck
*Assistant Examiner* — Aaron Lembo
(74) *Attorney, Agent, or Firm* — Chamberlain Hrdlicka

(57) ABSTRACT

An accumulator for a subsea blowout preventer unit including a blowout preventer includes a body. The body includes a hydraulic fluid chamber and a gas chamber. The hydraulic fluid chamber has a smaller inner diameter than the gas chamber. The accumulator further includes a hydraulic fluid port in fluid communication between the hydraulic fluid chamber and the subsea blowout preventer, a hydraulic piston slidably and sealingly mounted in the hydraulic fluid chamber, and a charge piston slidably and sealingly mounted in the gas chamber. A pressure port receives pressure to provide a force on the opposite side of the charge piston from the hydraulic piston.

17 Claims, 3 Drawing Sheets

(56) References Cited

U.S. PATENT DOCUMENTS

| | | | | | |
|---|---|---|---|---|---|
| 3,487,228 | A | * | 12/1969 | Kriegel | 290/52 |
| 3,677,001 | A | * | 7/1972 | Childers et al. | 60/398 |
| 3,743,013 | A | * | 7/1973 | Harbonn | 166/368 |
| RE28,177 | E | * | 10/1974 | England et al. | 303/7 |
| 3,984,990 | A | | 10/1976 | Jones | |
| 3,987,708 | A | * | 10/1976 | Uhrich | 92/134 |
| 4,095,421 | A | * | 6/1978 | Silcox | 60/398 |
| 4,112,687 | A | * | 9/1978 | Dixon | 60/641.6 |
| 4,145,959 | A | * | 3/1979 | Burden et al. | 92/8 |
| 4,294,284 | A | * | 10/1981 | Herd | 137/613 |
| 4,649,704 | A | * | 3/1987 | Marsh | 60/415 |
| 4,777,800 | A | | 10/1988 | Hay, II | |
| 4,811,558 | A | * | 3/1989 | Baugh | 60/281 |
| 4,923,005 | A | * | 5/1990 | Laky et al. | 166/55 |
| 6,125,938 | A | * | 10/2000 | Garcia-Soule et al. | 166/344 |
| 6,202,753 | B1 | * | 3/2001 | Baugh | 166/364 |
| 6,729,130 | B1 | * | 5/2004 | Lilleland | 60/413 |
| 7,329,070 | B1 | | 2/2008 | Trent et al. | |
| 7,424,917 | B2 | * | 9/2008 | Martin | 166/335 |
| 7,520,129 | B2 | * | 4/2009 | Springett | 60/398 |
| 7,628,207 | B2 | * | 12/2009 | Leonardi et al. | 166/364 |
| 7,735,563 | B2 | * | 6/2010 | Judge et al. | 166/357 |
| 7,934,561 | B2 | * | 5/2011 | Ormond | 166/355 |
| 8,181,704 | B2 | * | 5/2012 | Fenton | 166/338 |
| 2003/0019636 | A1 | * | 1/2003 | Robichaux | 166/380 |
| 2003/0037544 | A1 | * | 2/2003 | Armstrong | 60/413 |
| 2004/0031622 | A1 | * | 2/2004 | Butler et al. | 175/5 |
| 2005/0022996 | A1 | * | 2/2005 | Baugh | 166/363 |
| 2005/0074296 | A1 | * | 4/2005 | McCarty et al. | 405/224.4 |
| 2008/0104951 | A1 | * | 5/2008 | Springett | 60/413 |
| 2008/0185046 | A1 | * | 8/2008 | Springett et al. | 137/14 |
| 2009/0127482 | A1 | * | 5/2009 | Bamford | 251/1.3 |

* cited by examiner

SUBSEA DIFFERENTIAL-AREA ACCUMULATOR

CROSS-REFERENCE TO RELATED APPLICATIONS

This application is a 35 U.S.C. §371 national stage application of PCT/US2009/052709 filed Aug. 4, 2009, which claims the benefit of U.S. Provisional Patent Application No. 61/086,029 filed Aug. 4, 2008, both of which are incorporated herein by reference in their entireties for all purposes.

BACKGROUND

Deepwater accumulators provide a supply of pressurized working fluid for the control and operation of subsea equipment, such as through hydraulic actuators and motors. Typical subsea equipment may include, but is not limited to, blowout preventers (BOPs) that shut off the well bore to secure an oil or gas well from accidental discharges to the environment, gate valves for the control of flow of oil or gas to the surface or to other subsea locations, or hydraulically actuated connectors and similar devices.

Accumulators are typically divided pressure vessels with a gas section and a hydraulic fluid section that operate on a common principle. The principle is to precharge the gas section with an inert, dry, ideal gas (usually nitrogen or helium), pressurized to a pressure at or slightly below the anticipated minimum pressure required to operate the subsea equipment. Hydraulic fluid will then be added (or "charged") to the accumulator in the separate hydraulic fluid section, increasing the pressure of the pressurized gas and the hydraulic fluid to the maximum operating pressure of the control system. The precharge pressure determines the pressure of the very last trickle of fluid from the fluid side of the accumulator, and the charge pressure determines the pressure of the very first trickle of fluid from the fluid side of the accumulator. The discharged fluid between the first and last trickle will be at some pressure between the charge and precharge pressure, depending on the speed and volume of the discharge and the ambient temperature during the discharge event. The hydraulic fluid introduced into the accumulator is therefore stored at the maximum control system operating pressure until the accumulator is discharged for the purpose of doing hydraulic work.

Accumulators generally come in three styles—the bladder type having a balloon type bladder to separate the gas from the fluid, the piston type having a piston sliding up and down a seal bore to separate the fluid from the gas, and the float type with a float providing a partial separation of the fluid from the gas and for closing a valve when the float approaches the bottom to prevent the escape of the precharging gas. A fourth type of accumulator is pressure compensated for water depth and adds the precharge pressure plus the ambient seawater pressure to the working fluid.

The precharge gas can be said to act as a spring that is compressed when the gas section is at its lowest volume/greatest pressure and released when the gas section is at its greatest volume/lowest pressure. Accumulators are typically precharged on the surface in the absence of hydrostatic pressure and subsequently charged with hydraulic fluid on the seabed under full hydrostatic pressure. The surface precharge pressure is limited by the pressure containment and structural design limits of the accumulator vessel under surface ambient conditions. Yet, as accumulators are used in deeper water, the efficiency of conventional accumulators decreases as application of hydrostatic pressure causes the gas to compress, leaving a progressively smaller volume of gas to charge the hydraulic fluid. The gas section must consequently be designed such that the gas still provides enough power to operate the subsea equipment under hydrostatic pressure even as the hydraulic fluid approaches discharge and the gas section is at its greatest volume/lowest pressure.

As shown in FIGS. 1 and 2, accumulators may be included, for example, as part of a subsea BOP stack assembly 10 assembled onto a wellhead assembly 11 on the sea floor 12. The BOP stack assembly 10 is connected in line between the wellhead assembly 11 and a floating rig 14 through a subsea riser 16. The BOP stack assembly 10 provides emergency pressure control of drilling/formation fluid in the wellbore 13 should a sudden pressure surge escape the formation into the wellbore 13. The BOP stack assembly thus prevents damage to the floating rig 14 and the subsea riser 16 from fluid pressure exiting the seabed wellhead.

The BOP stack assembly 10 includes a BOP lower marine riser package (LMRP) 18 that connects the riser 16 to a BOP stack package 20. The BOP stack package 20 includes a frame 22, BOPs 23, and accumulators 24 that may be used to provide back up hydraulic fluid pressure for actuating the BOPs 23. The accumulators 24 are nested into the BOP stack package 20 to maximize the available space and leave maintenance routes clear for working on the components of the subsea BOP stack package 20. However, the free space available for all required BOP stack package components such as remote operated vehicle (ROV) panels and mounted control pods, and related equipment has become increasingly difficult due to the increasing number and size of the accumulators 24 for drilling operations in deeper water depths. Depending on the depth of the wellhead assembly 11 and the design of the BOPs 23, numerous accumulators 24 must be included on the frame 22, taking up valuable space on the frame 22 and adding weight to the subsea BOP stack assembly 10.

The use of traditional accumulators at extreme water depths requires large aggregate accumulator volumes that increase the size and weight of the overall subsea equipment assemblies. Yet, offshore rigs continue moving further and further offshore to drill in deeper and deeper water. Because of the ever increasing envelop of operation, traditional accumulators are becoming unmanageable with regards to quantity and location inside existing stack frames. In some instances, it has even been suggested that in order to accommodate the increasing demands of the conventional accumulator system, a separate subsea skid may have to be run in conjunction with the subsea BOP stack in order to provide the required volume necessary at the limits of the water depth capability of the subsea BOP stack. With rig operators increasingly putting a premium on minimizing size and weight of the drilling equipment to reduce drilling costs, the size and weight of all drilling equipment must be optimized.

BRIEF DESCRIPTION OF THE DRAWINGS

For a more detailed description of the embodiments, reference will now be made to the following accompanying drawings.

DETAILED DESCRIPTION OF THE EMBODIMENTS

Figure 1:
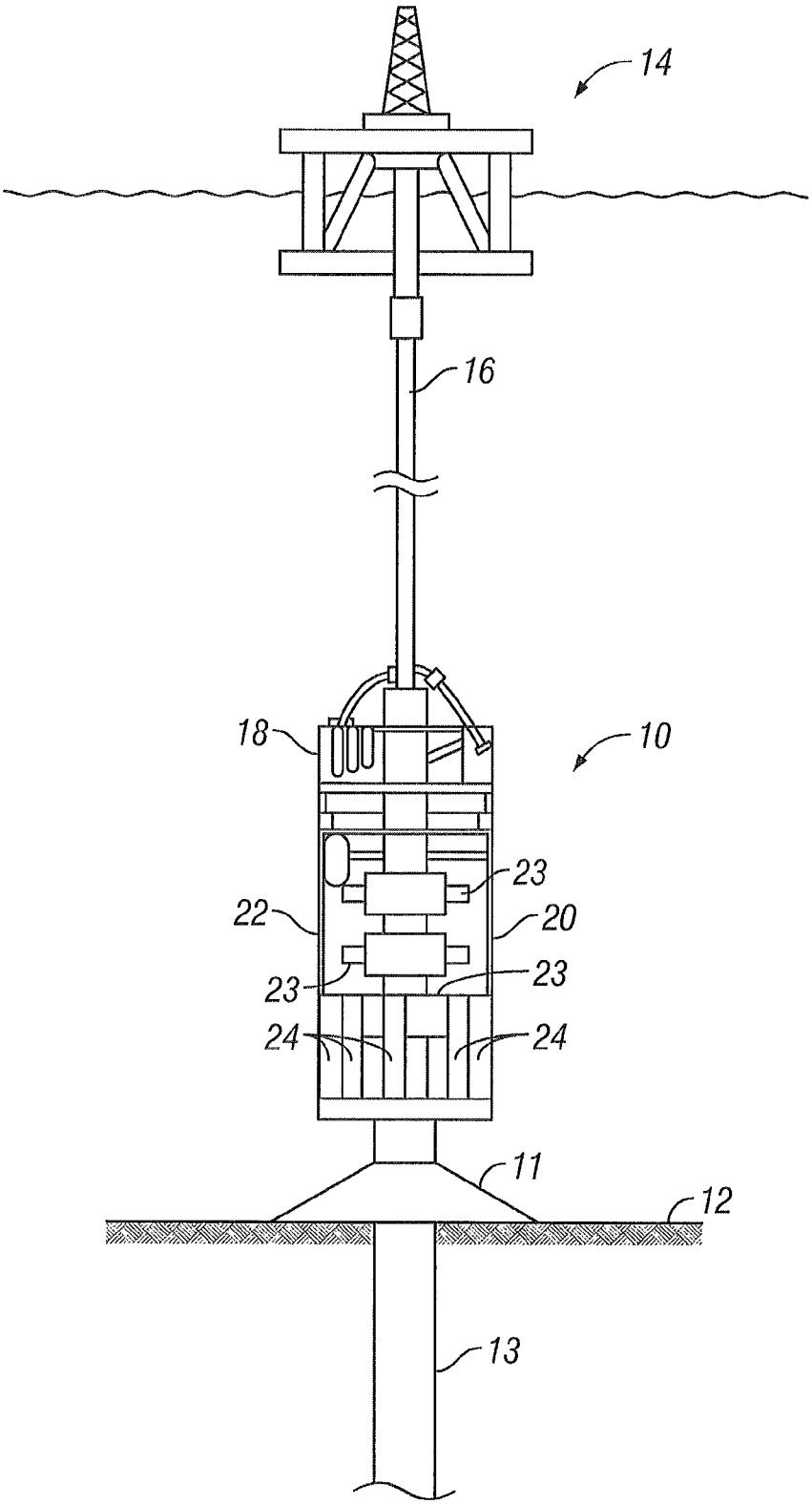
FIG. 1 is a schematic of a subsea BOP stack assembly connecting a wellhead assembly to a floating rig through a subsea riser.
Figure 2:
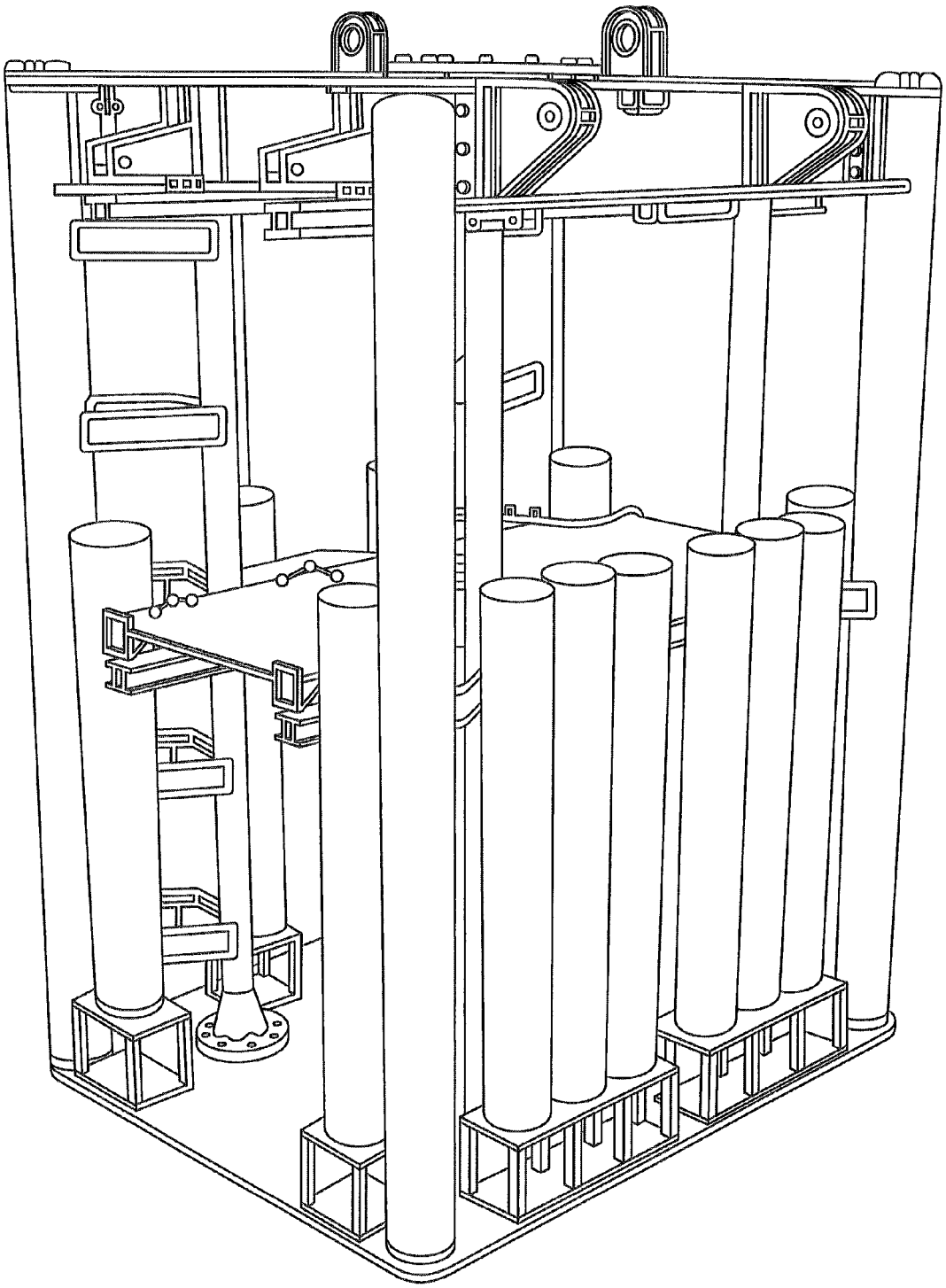
FIG. 2 is a perspective view of a BOP package of the BOP stack assembly of FIG. 1.

In the drawings and description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

As accumulators are used in deeper and deeper water, the efficiency of conventional accumulators decreases as application of external hydrostatic pressure changes the downstream pressure requirements to operate the subsea equipment. To fully understand the subsea performance characteristics of a subsea control systems utilizing accumulators, a thorough understanding of the differences between absolute (psia) and differential (psid or psig (gauge)) pressure is required. Accumulator maximum pressure ratings always reference psid, or the differential between the pressure inside the accumulator and the pressure outside the accumulator. On the surface, the atmospheric pressure of 14.92 psi is negligible and often ignored, however, on the ocean seabed at any depth past 500 feet, it must be compensated for in order to achieve proper operation of hydraulically actuated machines such as BOPs, valves, and connectors. Because the discharge ports of all the subsea hydraulic actuators are subjected to the full hydrostatic pressure, the inlet ports must be subjected to their normal operating pressure plus the hydrostatic pressure in order for the actuator to perform as expected. In the case of a subsea accumulator, the hydrostatic pressure, in effect, diminishes the precharge pressure, from a psid perspective, while the subsea charge pressure automatically compensates for hydrostatic pressure because the charging line, by necessity, runs from the surface to the seabed thereby duplicating the natural hydrostatic pressure inside the hydraulic charging line.

For example, accumulators at the surface typically provide 3000 psid working fluid maximum pressure (control system maximum pressure) while utilizing a 5000 psid maximum pressure rated accumulator and surface precharged to 1000 psid (to determine minimum operating pressure), and charged to 3000 psid with hydraulic fluid (to determine the maximum operating pressure). In 1000 feet of seawater the hydrostatic pressure is approximately 465 psia. For an accumulator to provide 3000 psid at 1000 ft. depth with the same 1000 psi minimum pressure (precharge), it must actually be precharged to 1000 psi plus 465 psi, or 1465 psi, and then charged with 3465 psi fluid.

To achieve the same operating parameters at 10000 ft. water depth, the hydrostatic pressure is 4650 psia, so the surface precharge would be 1000 psid plus 4650 psid, or 5650 psid (hydrostatic pressure is always "absolute" while accumulator pressure is always "differential"). This would mean that the precharge would exceed the maximum working pressure of a 5000 psi accumulator. Thus, a stronger accumulator capable of withstanding the 5650 psid precharge would be required. Then, once the accumulator reached the seabed at 10000 ft, the 4650 psia hydrostatic pressure "nets" the precharge pressure to the original 1000 psid (5650−4650=1000). Then, the accumulator can be charged with 3000 psid from the surface to make it ready for operation.

As can be seen by the above examples, there is a trend toward higher and higher pressure ratings on accumulators used subsea as the operating water depth increases. Further, this trend is exacerbated if the precharge or operating pressures used in the above examples must be increased, such as a 2500 psid precharge pressure to allow a BOP to shear specific sized drill pipe, or if a 5000 psid control system is utilized. In this example, the precharge would be 2500 psid plus the 4650 psia hydrostatic, yielding required surface precharge pressure of 7150 psid. As can be expected, accumulators with a higher rated working pressure (e.g. greater wall thickness, higher strength shell and head material, etc.) are more expensive than equivalently sized accumulators with a lower working pressure rating. Thus, the surface precharge pressure is an important consideration when determining the maximum working pressure (and thereby, the cost) for accumulators used subsea.

Historically, piston accumulators have had the same piston area for both the gas side and the fluid side. One or more embodiments of the present disclosure utilize a piston accumulator that has a larger gas area (larger piston) than the area of the fluid piston. Since the fluid end responds to the force exerted upon it by the gas piston, rather than the pressure on the gas piston, the mechanical advantage of the larger gas piston results in a lower required precharge pressure for a given size of accumulator.

For example, if the piston area ratio is 2:1 (gas side advantage), then the precharge pressure for a given accumulator application will only be half what is required for an equivalently sized accumulator with equal piston areas. Reviewing our original 10000 ft. water depth example with a 2500 psid minimum pressure requirement, the original 7150 psid precharge can be reduced by half to 3575 psi by utilizing a differential area accumulator with a 2:1 area ratio.

Figure 3:
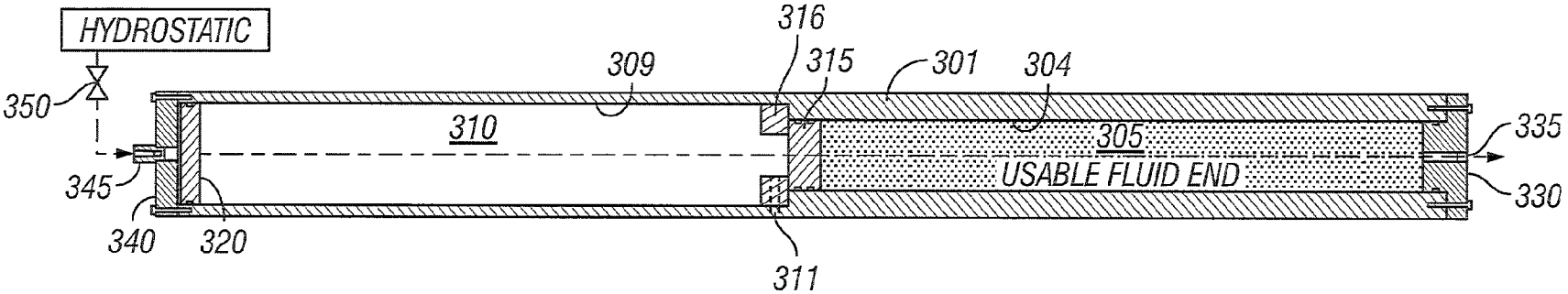
FIG. 3 a cross-section view of an accumulator in accordance with one embodiment of the claimed subject matter.

In FIG. 3, an accumulator 300 includes an accumulator body 301 with a hydraulic fluid portion 304 and a charge fluid portion 309. The hydraulic fluid portion 304 partially forms a hydraulic fluid chamber 305 and the charge fluid portion 309 partially forms a precharge gas chamber 310. An end cap 330 having a hydraulic fluid port 335 seals off an end of the hydraulic fluid portion 304 at one end of the accumulator 300. Another end cap 340 having a hydrostatic pressure port 345 seals off an end of the charge fluid portion 309 at the other end of the accumulator 300.

A hydraulic piston 315 is slidably and sealingly mounted in the hydraulic fluid portion 304. The hydraulic fluid chamber 305 is defined in the hydraulic fluid portion 304 between the hydraulic piston 315 and the end cap 330. A charge piston 320 is slidably and sealingly mounted in the charge fluid portion

309. The precharge gas chamber 310 is defined in the charge fluid portion 309 between the charge piston 320 and the hydraulic piston 315.

At the surface before installation on the sea floor, a precharge gas, such as nitrogen or helium, is provided into the precharge gas chamber 310 and pressurized according to predetermined calculations for depth, minimum operating pressure, and operating temperature at which the accumulator will operate. A precharge pressure port 311 may be, for example, in the side of the accumulator body 301 or in the charge piston 320. During pressurization of the precharge gas chamber 310, the hydraulic piston 315 moves towards the end cap 330. In one embodiment, pressure port 345 may be precharged with precharge gas, instead of or in addition to the precharge gas through precharge pressure port 311. After placement on the seafloor, hydraulic fluid is pumped into the hydraulic fluid chamber 305, which moves the hydraulic piston 315 towards the opposing end of the hydraulic fluid portion 304 until contacting a shoulder 316. The hydraulic fluid may be any suitable hydraulic fluid and may also include performance enhancing additives such as a lubricant. The accumulator 300 is then completely filled and ready to provide pressurized hydraulic fluid to operate the equipment on the BOP stack.

In normal operation, the force of the precharge gas acting against the hydraulic piston 315 is sufficient to operate the subsea equipment with the hydraulic fluid stored in the hydraulic fluid chamber 305. However, in case additional force is needed, the accumulator 300 further includes a valve 350, which communicates ambient hydrostatic pressure through the port 345 when open. That hydrostatic pressure acts against the charge piston 320 and increases the pressure within the precharge gas chamber 310. The increased pressure of the precharge gas in turn acts against the hydraulic piston 315 to increase the pressure of the hydraulic fluid. As hydraulic fluid is forced out of the hydraulic fluid chamber 305 by movement of the hydraulic piston 315, the charge piston 320 will move in the same direction with hydrostatic pressure continuing to act against the charge piston 320. Because hydrostatic pressure acts against the charge piston 320, the effective increase in pressure of the hydraulic fluid is increased proportional to the difference in piston diameters, giving a multiplier effect to the hydrostatic pressure upon the hydraulic piston 315. The hydrostatic pressure provides a boost in the force acting on the subsea equipments, such as hydraulic rams of a blowout preventer, which may be useful in an emergency situation. As the hydraulic rams close and the hydraulic fluid exits the accumulator 300, seawater will flow into the accumulator to apply the constant hydrostatic pressure. Thus, the force applied by the hydraulic rams remains constant between the fully opened and fully closed positions.

Figure 4:
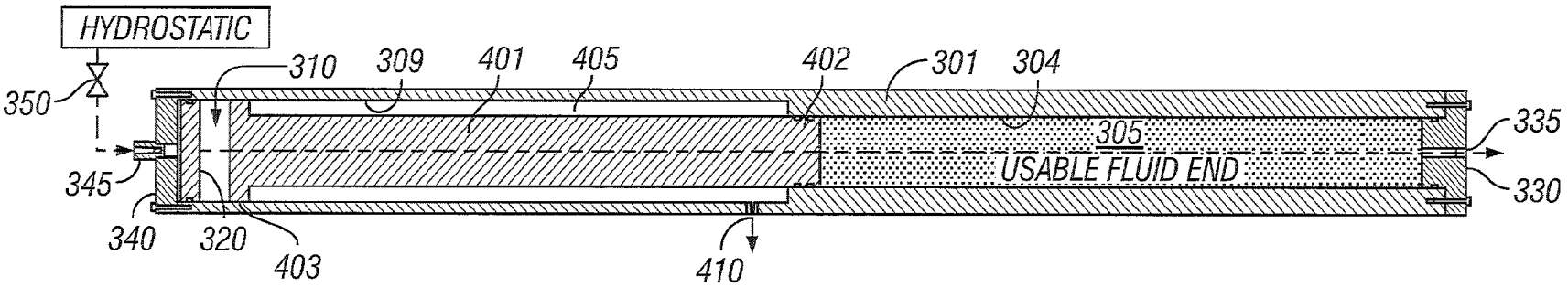
FIG. 4 is a cross-section view of an accumulator in accordance with one embodiment of the claimed subject matter.

Referring now to FIG. 4, another accumulator 400 is shown that shares many of the same components as the accumulator 300 shown in FIG. 3. In the accumulator of FIG. 4 however the hydraulic piston 315 is extended to form a piston body 401 that includes a hydraulic diameter portion 402 and a charge diameter portion 403. The hydraulic diameter portion 402 slidably and sealingly engages the inside of the hydraulic fluid portion 304 of the accumulator body 301, and the charge diameter portion 403 slidably and sealingly engages the inside of the charge fluid portion 309 of the accumulator body 301. Although shown as a solid piston body, those having ordinary skill in the art will appreciate that the piston body 401 may be a single hollow piece or any assembly of cylinders that results in a mechanical connection between the hydraulic diameter portion 402 and the charge diameter portion 403.

The hydraulic fluid chamber 305 is partially defined by the hydraulic fluid portion 402 of the piston body 401 and the end cap 330. A buffer chamber 405 is defined as the annular space between the outer diameter of the piston body 401 and the inner diameter of the charge fluid portion 309 of the accumulator body 301. At the surface before installation on the sea floor, the precharge gas is provided into the precharge gas chamber 310 defined between the charge piston 320 and the charge diameter portion 403 of the piston body 401 and pressurized according to a predetermined operating depth and pressure. As shown, the charge diameter portion 403 of the piston body 401 is larger than the hydraulic diameter portion 402. Thus, the necessary precharge pressure may be reduced proportional to the difference in effective piston area of the two portions of the piston body 401.

The pressure in the precharge gas chamber 310 at the surface causes the piston body 401 to move towards end cap 330, which reduces the size of the buffer chamber 405. Fluid, such as air, contained in the buffer chamber 405 may be vented through port 410. If port 410 is closed after the piston body 401 has travelled fully towards the end cap 330, the buffer chamber 405 will have a vacuum when the hydraulic fluid chamber 305 is filled with hydraulic fluid at the sea floor. By having a vacuum, none of the pressure in the precharge gas chamber 310 is counterbalanced by the buffer chamber 405. If air in the buffer chamber 405 is not vented, actuation of the piston body 401 will compress the air in the buffer chamber 405, thereby providing a pressure counterbalance to the precharge gas pressure.

In normal operation, the force of the precharge gas acting against the hydraulic piston 315 is sufficient to operate the subsea equipment with the hydraulic fluid stored in the hydraulic fluid chamber 305. However, in case additional force is needed, the accumulator 300 further includes a valve 350, which communicates ambient hydrostatic pressure through the port 345 when open. That hydrostatic pressure acts against the charge piston 320 and increases the pressure within the precharge gas chamber 310. The increased pressure of the precharge gas in turn acts against the charge diameter portion 403 of the piston body 401 to increase the pressure of the hydraulic fluid. As hydraulic fluid is forced out of the hydraulic fluid chamber 305 by movement of the hydraulic diameter portion 402 of the piston body 401, the piston body 401 will move in the same direction with hydrostatic pressure continuing to act against the charge diameter portion 403 of the piston body 401. Because hydrostatic pressure acts against charge diameter portion of the piston body 401 via the charge piston 320, the effective increase in pressure of the hydraulic fluid is increased proportional to the difference in piston diameters, giving a multiplier effect to the hydrostatic pressure upon the hydraulic diameter portion 402 of the piston body 401. The hydrostatic pressure provides a boost in the force acting on the subsea equipment, such as hydraulic rams of a blowout preventer, which may be useful in an emergency situation. As the hydraulic rams close and the hydraulic fluid exits the accumulator 300, seawater will flow into the accumulator to apply the constant hydrostatic pressure. Thus, the force applied by the hydraulic rams remains constant between the fully opened and fully closed positions.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. An accumulator for a subsea blowout preventer unit including a blowout preventer, including:

a body including a hydraulic fluid chamber and a precharge gas chamber, wherein the hydraulic fluid chamber has a smaller inner diameter than the precharge gas chamber;

a hydraulic fluid port in fluid communication between the hydraulic fluid chamber and the subsea blowout preventer;

a hydraulic piston slidably and sealingly mounted in the hydraulic fluid chamber;

a charge piston slidably and sealingly mounted in the precharge gas chamber and unconnected with the hydraulic piston;

a pressure port for receiving pressure to provide a force on the opposite side of the charge piston from the hydraulic piston; and wherein the precharge as chamber is pressurizable by a precharge gas disposed between the hydraulic piston and the charge piston.

2. The accumulator of claim 1, wherein the pressure port receives ambient pressure to provide a force on the opposite side of the charge piston from the precharge gas.

3. The accumulator of claim 2, further including:

a valve selectively controlling the exposure of the pressure port to ambient pressure.

4. The accumulator of claim 1, wherein the hydraulic piston includes a small diameter portion slidably and sealingly mounted in the hydraulic fluid chamber and connected to a larger diameter portion slidably and sealingly mounted in the gas chamber.

5. An accumulator for hydraulically actuating subsea equipment, the accumulator comprising:

a body with a hydraulic piston slideably disposed therein, the hydraulic piston separating a hydraulic fluid chamber and a precharge gas chamber;

a charge piston slideably disposed within the precharge gas chamber, the charge piston dividing the precharge gas chamber into a first portion and a second portion;

a precharge gas port disposed in the body, the precharge gas port configured to deliver a precharge gas into the second portion, whereby the second portion is pressurized to a preselected pressure;

a hydraulic fluid port disposed in the body, the hydraulic fluid port configured to exhaust a hydraulic fluid to the subsea equipment at a pressure substantially equal to the pressure of the precharge gas in the second portion; and a valve that is actuatable to an open position, wherein an ambient fluid flows into the first portion, whereby the charge piston displaces to increase the pressure of the precharge gas within the second portion above the preselected pressure.

6. The accumulator of claim 5, wherein a cross-sectional area of the hydraulic piston is less than a cross-sectional area of the charge piston, wherein both of the cross-sectional areas are normal to a longitudinal centerline of the body.

7. The accumulator of claim 6, wherein both of the charge piston and the hydraulic piston sealingly engage the body.

8. The accumulator of claim 5, further comprising a pressure port disposed in the body, the pressure port in fluid communication with the valve and the first portion of the precharge gas chamber.

9. The accumulator of claim 5, wherein the subsea equipment is a blowout preventer.

10. An accumulator for hydraulically actuating subsea equipment, the accumulator comprising:

a hydraulic chamber in fluid communication with the subsea equipment;

a precharge gas chamber with a charge piston slideably disposed therein, the charge piston dividing the precharge gas chamber into a first portion and a second portion, the second portion containing a precharge gas at a preselected pressure;

a hydraulic piston disposed between the hydraulic chamber and the second portion of the precharge gas chamber, the hydraulic piston movable under the pressure of the precharge gas in the second portion to exhaust a hydraulic fluid from the hydraulic chamber to the subsea equipment; and a pressure port in fluid communication with the first portion, the pressure port configured to receive an ambient fluid, whereby the charge piston displaces to increase the pressure of the precharge gas in the second portion.

11. The accumulator of claim 10, wherein the subsea equipment is a blowout preventer.

12. The accumulator of claim 10, further comprising a body, wherein the hydraulic chamber and the precharge gas chamber are disposed.

13. The accumulator of claim 12, wherein the pressure port is disposed in the body.

14. The accumulator of claim 12, wherein the body further comprises a hydraulic fluid port in fluid communication with the hydraulic fluid chamber and the subsea equipment.

15. The accumulator of claim 12, wherein the body further comprises a precharge gas port in fluid communication with the second portion of the precharge gas chamber.

16. The accumulator of claim 12, wherein both of the charge piston and the hydraulic piston sealingly engage the body.

17. The accumulator of claim 10, wherein a cross-sectional area of the hydraulic piston is less than a cross-sectional area of the charge piston, wherein both of the cross-sectional areas are normal to a longitudinal centerline of the accumulator.

* * * * *